United States Patent [19]

Lapergue et al.

[11] Patent Number: 4,724,671

[45] Date of Patent: Feb. 16, 1988

[54] DEVICE FOR CONNECTING A BURNER RING OR FLAME HOLDER TO AN AFTERBURNER DUCT OF A TURBOJET ENGINE

[75] Inventors: Guy J. Lapergue, Le Mee Sur Seine; Marc G. Loubet, Nandy; Marcel R. Soligny, Chevilly Larue, all of France

[73] Assignee: Societe Nationale d'Etude et de Constructions de Moteurs d'Aviation "S.N.E.C.M.A.", Paris, France

[21] Appl. No.: 903,250

[22] Filed: Sep. 3, 1986

[30] Foreign Application Priority Data

Sep. 3, 1985 [FR] France ..... 85 13047

[51] Int. Cl.[4] ..... F02K 3/10; F02C 1/00

[52] U.S. Cl. ..... 60/261; 60/743

[58] Field of Search ..... 60/261, 262, 241, 749

[56] References Cited

U.S. PATENT DOCUMENTS

| | | | |
|---|---|---|---|
| 3,269,116 | 8/1966 | Frusca et al. | 60/261 |
| 3,601,985 | 8/1971 | Bauger | 60/749 |
| 3,925,325 | 1/1967 | Nelson, Jr. | 60/261 |

FOREIGN PATENT DOCUMENTS

| | | | |
|---|---|---|---|
| 2202508 | 7/1980 | Fed. Rep. of Germany | 60/261 |
| 1232450 | 5/1964 | France . | |
| 1513429 | 1/1968 | France . | |
| 2090250 | 1/1972 | France . | |
| 2097587 | 3/1972 | France . | |
| 2107630 | 5/1983 | United Kingdom . | |

*Primary Examiner*—Louis J. Casaregola
*Assistant Examiner*—Timothy S. Thorpe
*Attorney, Agent, or Firm*—Bacon & Thomas

[57] ABSTRACT

A connection device is disclosed for connecting a burner ring or flame holder made of a composite material and having a "V"-shaped cross-section, to an afterburner chamber duct of a turbojet engine. The connecting device has a cylindrical portion and a trapezoidal portion. The cylindrical portion extends through hollow projections formed from the composite ring material and extending from the ring in an upstream direction. The converging, opposite sides of the trapezoidal portion bear against inner surfaces of the converging flanges forming the "V" cross-section of the ring. The cylindrical portion is then attached to the afterburner duct via a link-bar mechanism.

9 Claims, 6 Drawing Figures

DEVICE FOR CONNECTING A BURNER RING OR FLAME HOLDER TO AN AFTERBURNER DUCT OF A TURBOJET ENGINE

BACKGROUND OF THE INVENTION

The use of composite materials to fabricate certain parts of a turbojet engine requires special means to attach these parts to metallic parts. This is especially true in areas of high temperature, since the coefficients of thermal expansion for the two materials vary greatly.

In the case of an annular burner ring or a flame holder the particular problem relates to the attachment points of the burner ring or flame holder to the adjacent afterburner duct. The metallic duct and the attaching fork-joints have a coefficient of expansion approximately three times greater than that of the composite material forming the burner ring or flame holder.

SUMMARY OF THE INVENTION

It is an object of the present invention to provide a connection device for attaching a composite element such as a burner ring or flame holder, to a metallic element, such as an afterburner chamber duct which will minimize the problems associated with the prior art devices. The device according to the invention comprises a cylindrical portion and a generally trapezoidal portion and is intended for use with a burner ring or flame holder having a generally "V"-shaped cross-section. The annular burner ring or flame holder also defines a plurality of projections extending in an upstream direction such that the cylindrical portion of the connecting device is accommodated therein. The upstream distal end portion of the generally cylindrical portion is attached, via a link, to the afterburner chamber duct. The generally trapezoidal portion of the connecting device has opposite, converging sides which bear against an inner surface of the generally "V"-shaped burner ring. The dimension of the trapezoidal portion, measured in the radial direction, is larger than the diameter of the cylindrical portion.

The device according to the invention provides increased reliability for fastening the burner ring to the afterburner duct by absorbing drag stresses by resting in counterflow on the inner surfaces of the burner ring.

The device is also readily assembled and disassembled to facilitate engine maintenance. The connecting parts may be re-used even if it is necessary to replace the burner ring or flame holder. When the device is utilized with a burner ring, it may also be utilized to affix the fuel feed manifold.

DETAILED DESCRIPTION OF THE PREFERRED EMBODIMENTS

Figure 1:
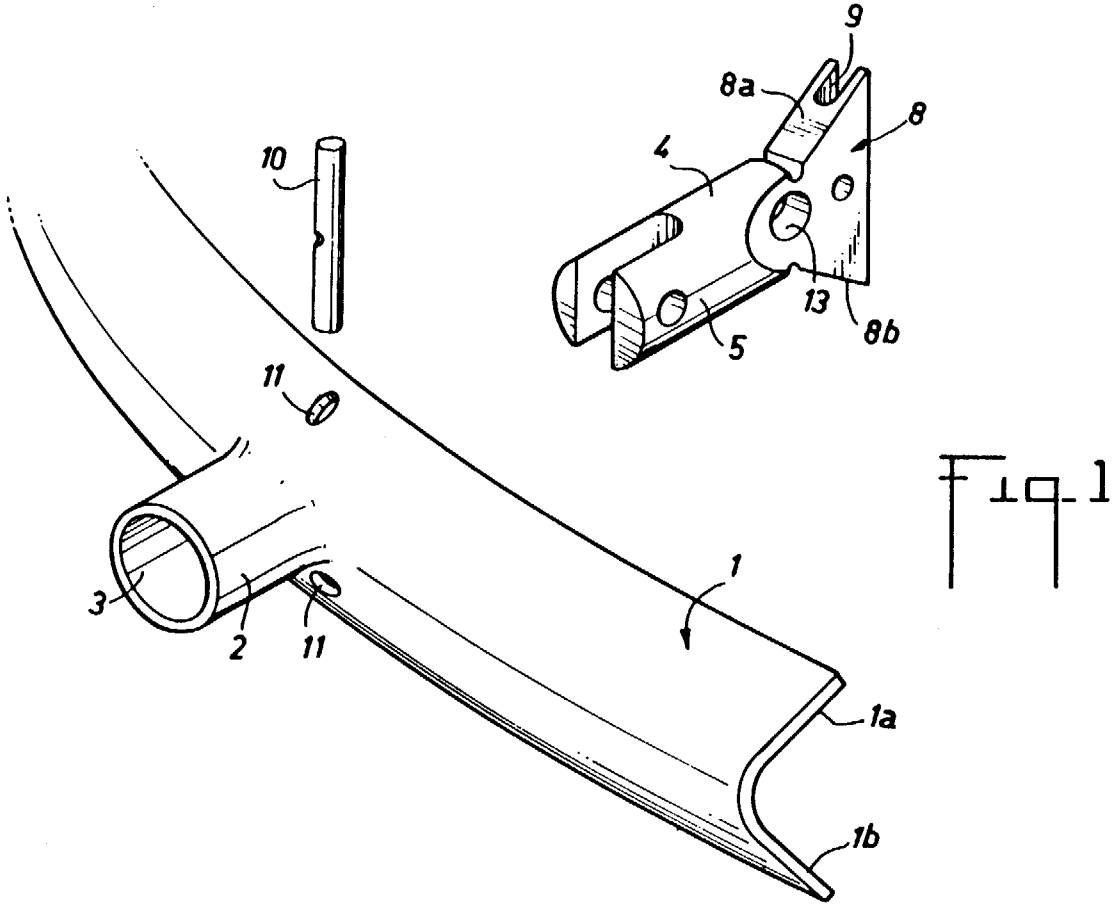
FIG. 1 is an exploded, partial perspective view showing a first embodiment of the connection device according to the invention associated with a burner ring or flame holder.
Figure 2:
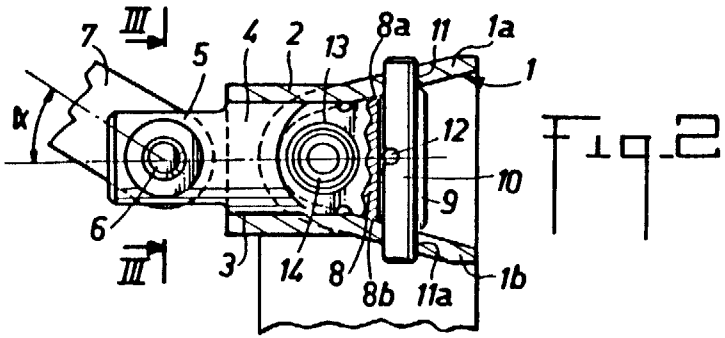
FIG. 2 is a cross-sectional view of the burner ring showing a first embodiment of the connection device as seen in FIG. 1.
Figure 3:
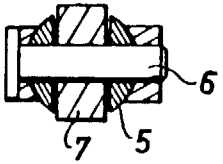
FIG. 3 is a cross-sectional view taken along line III—III in FIG. 2.

FIGS. 1, 2 and 3 illustrate a first embodiment of the connection device according to the invention. The connection device is utilized to attach a burner ring or flame holder 1 made of a composite material to an afterburner chamber duct (not shown) of a turbojet engine. Ring 1 has a generally "V"-shaped cross-section formed by two flanges 1*a* and 1*b* converging in the upstream direction. Projections 2, formed of the same composite material as the ring itself, extend from the ring 1 in an upstream direction and define a bore 3 therethrough.

The connection device has a cylindrical portion 4 which defines a female clevis joint 5 at its distal end. The cylindrical portion 4 passes through the bore 3 defined in projections 2 and is connected to a link bar 7 (see FIGS. 2 and 3) by a pivot pin 6. The opposite end of link bar 7 is hingedly attached to the superstructure of the afterburner chamber duct of the turbojet engine. It is believed that this connection is well known in the art and it need not be described in more detail. A slight play must be provided to compensate for the differences in expansion between the bore 3 of the projection 2 and the cylindrical part 4 of the connecting device. The engagement of cylindrical portion 4 with the link bar 7 transmits the generated torque by slanting link bar 7 at an angle $\alpha$ to the ring 1.

The connecting device also has a generally trapezoidally shaped portion 8 attached to the cylindrical portion 4 so as to retain it within the ring 1. The trapezoidal portion 8 has two opposite surfaces 8*a* and 8*b* which subtend between them a specific angle and converge in the upstream direction. The angle is such that the opposite surfaces 8*a* and 8*b* bear against the corresponding inner surfaces of the flanges 1*a* and 1*b* of ring 1. The stress imparted to the ring by the air rapidly flowing thereover is readily absorbed by the connecting device due to the interengagement of the surfaces 8*a* and 8*b* with 1*a* and 1*b*, respectively.

Trapezoidal portion 8 also defines a generally radially extending slot 9 in its downstream edge portion. Radial pin 10 extends through the radial slot 9 and also extends through openings 11 and 11*a* formed through flanges 1*a* and 1*b* of ring 1. The radial movement of radial pin 10 is prevented and the radial pin 10 is locked into the trapezoidal portion 8 by transverse pin 12 which extends through transverse openings in the trapezoidal portion and a notch formed through one side radial pin 10.

When the connecting device is utilized to connect a burner ring, trapezoidal portion 8 may also define a transverse manifold opening 13 to accommodate the passage therethrough of fuel feed manifold 14 (see FIG. 2).

Figure 5:
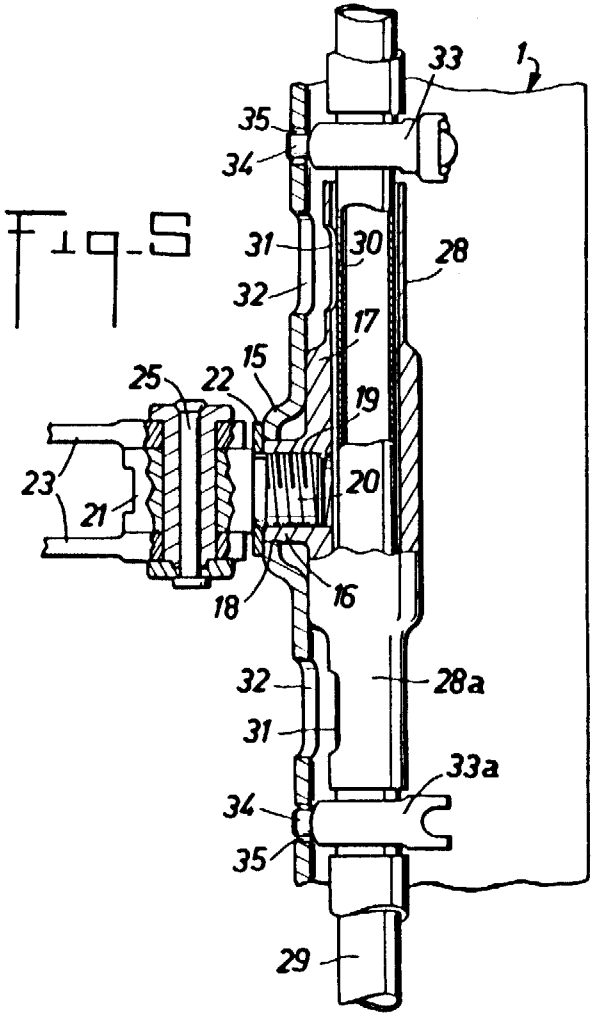
FIG. 5 is a partial, sectional view taken along line V—V in FIG. 6 showing the embodiment of FIG. 4.
Figure 6:
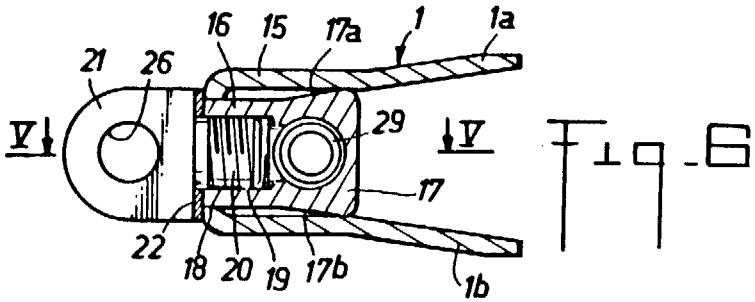
FIG. 6 is a cross-section view of the embodiment shown in FIGS. 4 and 5.
Figure 4:
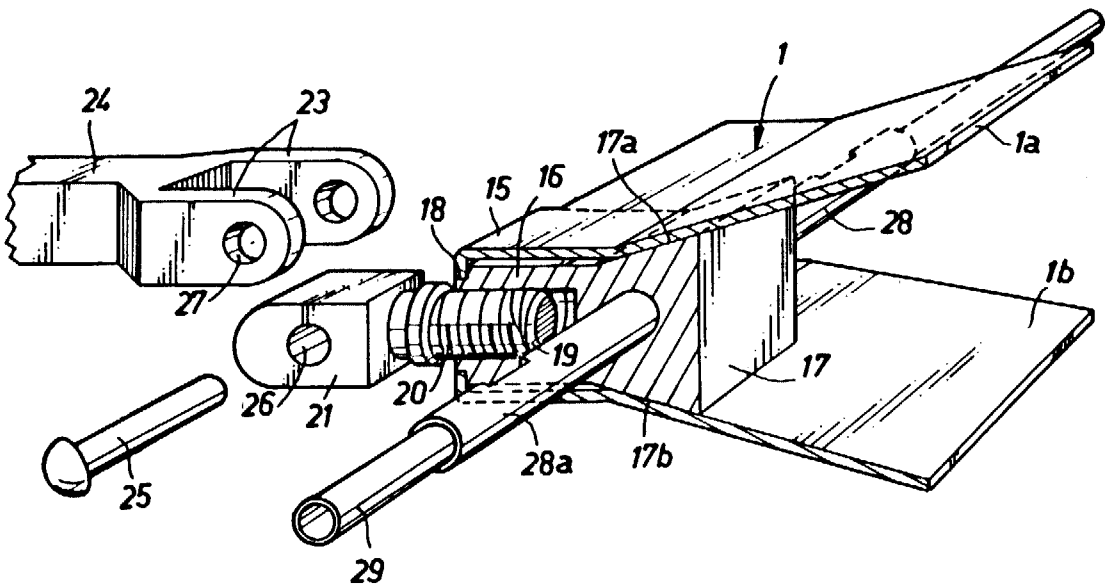
FIG. 4 is an exploded, partial perspective view of a second embodiment of a connection device according to the invention.

A second embodiment of the invention is shown in FIGS. 4, 5 and 6. This embodiment is for use with composite ring 1 which has converging, "V"-shaped flanges 1*a* and 1*b* and which is provided with regularly spaced projections 15, made of the same composite material as the ring itself. In this embodiment, cylindrical portion 16 passes into the projections 15, while trapezoidal portion 17 has converging surfaces 17*a* and 17*b* which bear against the inner surfaces of flanges 1*a* and 1*b* of the ring 11 as previously described.

The cylindrical portion 16 is aligned with aperture 18 formed in the projection 15 and defines a threaded opening 19 aligned with the aperture. An attaching member 21, such as an eye joint, has threaded portion 20 which threadingly engages hole 19. Washer 22 may be interposed between the end of projection 15 and the attaching member 21 if desired. The attaching member 21 is pivotally attached to a clevis joint 23 formed on one end of link bar 24 by a pivot pin 25 extending through aligned apertures 26 and 27 formed in these elements. The other end of link bar 24 (not shown) is pivotally attached to the duct of the afterburner chamber in known fashion.

Transverse, hollow arms 28 and 28a may be attached to trapezoidal portion 17 so as to extend transversely from either side thereof. Arms 28 and 28a are hollow and serve to enclose fuel feed manifold 29. Fuel feed manifold 29 is provided with regularly spaced fuel openings 30. Arms 28 and 28a also define fuel openings 31 aligned with the fuel openings 30. The ring 1 may also define fuel openings 32 aligned with those formed in the arms and the fuel feed manifold 29.

Centering brackets 33 and 33a are slipped over the manifold 29 and are located on either side of the cylindrical arms 28 and 28a. Stud 34 extending from the upstream end of the centering brackets passes into cutout 35 formed on the leading edge of ring 1 so as to properly locate the centering brackets.

The foregoing description is provided for illustrative purposes only and should not be construed as any way limiting this invention, the scope of which is defined solely by the appended claims.

What is claimed is:

1. A device for connecting an annular burner ring or flame holder made of composite material having opposite sides forming a generally "V" shaped cross-section to an afterburner duct of a turbojet engine, the afterburner duct having one end of a plurality of connecting links thereto, the device comprising:

(a) a projection extending from the annular burner ring or flame holder in an upstream direction, the projection defining a bore therethrough;

(b) an eye bolt comprising:

(i) a generally cylindrical portion adapted to extend through the bore of the projection; and, (ii) a generally trapezoidal portion having opposite, converging sides adapted to bear against sides of the generally "V" shaped burner ring, the longest dimension of the trapezoidal portion in the radial direction being larger than the diameter of the cylindrical portion;

(c) attaching means to attach the cylindrical portion to one of the connecting links;

(d) a generally radially extending slot defined by the trapezoidal portion;

(e) openings defined by the sides of the burner ring; and, (f) a radial pin inserted into the generally radial slot and extending through the openings.

2. The device according to claim 1 further comprising:

(a) a transverse hole defined by the trapezoidal portion, the hole extending on either side of the generally radial slot;

(b) a transverse notch defined in one side of the radial pin, the notch being aligned with the transverse hole when the radial link pin is in its desired location; and, (c) a transverse pin extending through the transverse hole and the transverse notch so as to lock the radial pin in position.

3. The device according to claim 1 further comprising a transverse manifold opening defined by the generally trapezoidal portion adapted to accommodate a fuel feed manifold associated with the burner ring.

4. The device according to claim 1 wherein the cylindrical portion defines a female clevis joint on a distal end for connection with the connecting link.

5. A device for connecting an annular burner ring or flame holder made of composite material having opposite sides forming a generally "V" shaped cross-section to an afterburner duct of a turbojet engine, the afterburner duct having one end of a plurality of connecting links attached thereto, the device comprising:

(a) a projection extending from the annular burner ring or flame holder in an upstream direction, the projection defining a bore therethrough;

(b) an eye bolt comprising:

(i) a generally cylindrical portion adapted to extend through the bore of the projection; and, (ii) a generally trapezoidal portion having opposite, converging sides adapted to bear against sides of the generally "V" shaped burner ring, the longest dimension of the trapezoidal portion in the radial direction being larger than the diameter of the cylindrical portion;

(c) attaching means to attach the cylindrical portion to one of the connecting links;

(d) an internally threaded opening defined in the cylindrical portion;

(e) an attaching member threadinly engaged with the cylindrical portion; and, (f) means to connect the attaching member to a connecting link.

6. The device according to claim 5 wherein the attaching member forms a male clevis link and is connected to a connecting link via a pivot pin extending through the connecting link and the attaching member.

7. The device according to claim 5 further comprising:

(a) a transverse, hollow arm extending transversely from both sides of the trapezoidal portion;

(b) a transverse opening defined by the arms and the trapezoidal portion to accommodate a fuel feed manifold having spaced first fuel openings; and (c) second fuel openings defined by the transverse hollow arms aligned with the first fuel openings so as to allow passage of fuel therethrough.

8. The device according to claim 7 wherein the annular burner ring defines third fuel openings therethrough aligned with the second fuel openings.

9. The device according to claim 7 wherein the burner ring defines a locating cut-out and further comprising:

(a) a centering bracket disposed adjacent the distal ends of the transverse arms; and, (b) a stud extending from each centering bracket and engaging a locating cut-out.

* * * * *

UNITED STATES PATENT AND TRADEMARK OFFICE

CERTIFICATE OF CORRECTION

PATENT NO. : 4,724,671

DATED : February 16, 1988

INVENTOR(S) : Lapergue et al

It is certified that error appears in the above—identified patent and that said Letters Patent is hereby corrected as shown below:

Col. 2, line 68, "ll" should be --1--.

Col. 3, line 39, after "links" insert --attached--.

Col. 4, line 3, "link" should be omitted.

Col. 4, line 36, "threadinly" should be --threadingly--.

Signed and Sealed this

Twenty-eighth Day of June, 1988

*Attest:*

*Attesting Officer*

DONALD J. QUIGG

*Commissioner of Patents and Trademarks*